United States Patent [19]

McBriarty

[11] Patent Number: 4,471,010

[45] Date of Patent: Sep. 11, 1984

[54] SPLICE FOR MULTI-PACKAGING DEVICE

[75] Inventor: Robert B. McBriarty, Elgin, Ill.

[73] Assignee: Illinois Tool Works Inc., Chicago, Ill.

[21] Appl. No.: 542,937

[22] Filed: Oct. 18, 1983

[51] Int. Cl.[3] ..... B32B 3/24; B32B 7/14; B32B 7/06

[52] U.S. Cl. ..... 428/57; 428/58; 428/194; 206/150; 242/58.5

[58] Field of Search ..... 428/57, 58, 192, 194; 206/150; 242/58.5, 58.1

[56] References Cited

U.S. PATENT DOCUMENTS 3,724,033 4/1973 Baker ..... 242/58.5 X

*Primary Examiner*—Alexander S. Thomas

*Attorney, Agent, or Firm*—Thomas W. Buckman

[57] ABSTRACT

A butt joint splice for attaching successive series of flexible multi-packaging devices. A pair of laterally spaced arms on a first series, adhesively secured and juxtaposed over selected areas of an extremity of a second series of devices create such a splice.

6 Claims, 2 Drawing Figures

SPLICE FOR MULTI-PACKAGING DEVICE

BACKGROUND OF THE INVENTION

Multi-packaging devices of sheet-like, flexible resilient plastic material are typically arranged and handled in reel-like, end-to-end relationship to facilitate their use in high speed applicating systems. Typical devices of the type described are those shown, for example, in U.S. Pat. Nos. 3,874,502, 4,018,331 and 4,212,911. A recently introduced device, such as shown in U.S. Pat. No. 4,269,308, for encircling a large plurality of containers also is handled in the end-to-end manner for high speed application.

It is important that the carrier devices that are fed in an end-to-end fashion are also capable of being readily separable from one another. To insure substantially continuous packaging each reel or segment of a reel must be associated with the other by some sort of a splice so that the application can be substantially continuous.

Heretofore, such splices have been simply accomplished by a staple which either butt or lap joined the ends of a series of carriers.

SUMMARY OF THE INVENTION

This invention is directed to a splice arrangement for securing one series of flexible carrier devices to another that insures continuous application of such carriers. The splice contemplates the use of adhesive securement between adjacent ends of successive series of carriers through the use of tabs which are integral with one series and which may be laped or juxtaposed over a predetermined small surface area on the extremity of the other series.

An object of the invention is to provide a splice for end-to-end arranged separable carriers which will withstand tension normally associated with the application and unreeling of such carriers.

A further object of the invention is to provide a adhesive type splice for an end-to-end series of carriers that reduces the bowing or lateral distortion of the carriers when subjected to unreeling tension.

An advantage of the present invention is the provision of a splice that reduces the double thickness area in a lapped splice and yet provides sufficient strength in shear and peel resistance to the splice.

Other objects, advantages and features of the invention will be apparent from the following description when taken in conjunction with the drawings.

DETAILED DESCRIPTION OF THE PREFERRED EMBODIMENT

Figure 1:
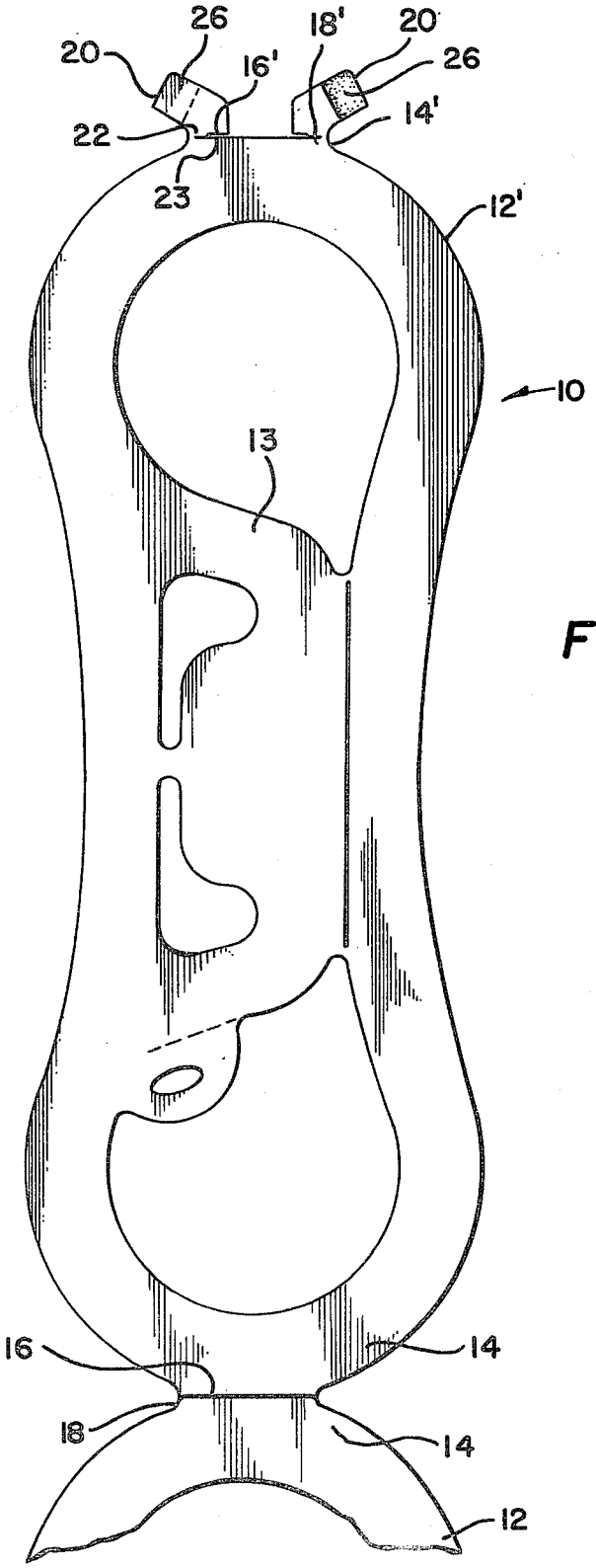
FIG. 1 is a top plan view of a portion of a series of carrier devices including the inventive splice member at one extremity of the series.

Turning first to FIG. 1 a typical carrier device 10 is shown which utilizes the inventive splice. Such a device is shown herein to be an endless band 12 designed to surround and define an array of a plurality of containers. The configuration and function of this carrier is more specifically described in U.S. Pat. No. 4,269,308, however, the details of such a carrier are exemplary and do not in any way restrict the spline invention disclosed herein. Carriers of this type are typically arranged in end-to-end fashion with separable connections 18 therebetween. Each carrier thus has a longitudinal extremity 14 which is integral with but separably connected to the next such carrier in the series through frangible regions 18 created by a lateral slit 16.

Such a series of carriers is wound or reeled about a core, to be fed or unreeled at relatively high speeds and under some tension, to a series of arrays of containers to be packaged. Thus, a slight tension force is exerted along the center line of the carrier during the application of the carrier.

The splice of the present invention is accomplished through the tab means 20, shown at the free extremity 14' of the series of carriers 10 in FIG. 1. Each of the tab means includes a pair of substantially identical, but mirror image tab members 20 situated on either side of the center line of the carrier device. Each tab is shown to include a base portion 22 integrally connected to the longitudinal extremity 14' of band 12' through a separable connection or hinge means 18'. An arm portion 24 angularly extends from the associated base portions. These arm portions, as shown in FIG. 1, diverge from the center line to and at least partially conform to the outer perimeter configuration of an extremity 14 of a device.

Figure 2:
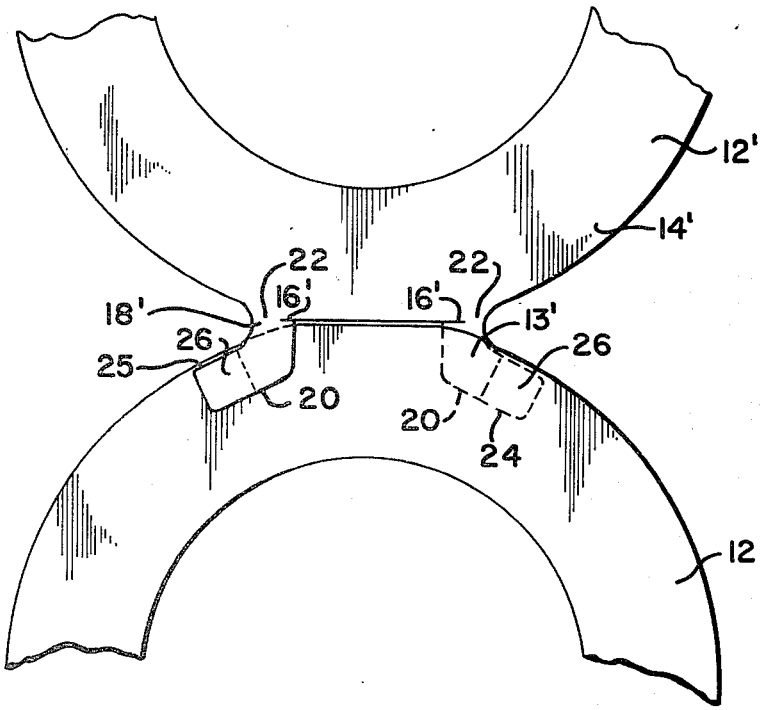
FIG. 2 is a fragmentary enlarged plan view of the splice of the present invention.

Turning now to FIG. 2 it will be shown how this splice is actually created and used. The extremities 14 and 14' of successive series of devices are placed in abutting position. So the tabs 20 overlap a selected mating region or surface area 13 of the band 12. An adhesive securement is accomplished between the surface area of the tab and the predetermined surface area of the band 12. In the preferred embodiment adhesive area 26 is formed on opposite side of opposing tabs 20. It will be noted that a slit 16' is formed at the base of the arm to provide a frangible connection 18' similar in dimension to the frangible connections 18 that exists in each of the successive carrier devices in the series, thus permitting each device to be separated from the remaining devices during the normal packaging operation without stopping or changing the speed when the spliced region occurs.

It is important to note that when such devices are being broken apart by tension in the application process there may be a tendency for the bands to bow or arch laterally of the device. This is due to the fact that the winding tension is directed primarily on the centerline of the series of devices and the lateral edges of each device are free to respond or react to such tension. The lateral spacing of integral frangible regions 18' reduces this tendency but doesn't eliminate it.

In an adhesive bonded splice of the type contemplated, the forces on the band created by the tension and bowing in turn create certain sheer and peel forces on the faying surfaces of the bond. In order to overcome peel force, larger areas of adhesive are required, however, with such larger areas the amount of available stretchable material in the packaging device necessarily becomes smaller. Therefore, the size of the bond must be kept to a minimum.

To reduce such peel forces and reactions it has been found that positionment of the tabs 20 on opposite sides of the adjacent extremity 14 provides an optimum splice.

It has been further found that the bonding area can be effectively reduced by insuring that the bond occurs at an area 13 adjacent outer perimeter edge of the band. Arms with at least edges 25 that conform to the outer perimeter edge adjacent area 13 is desired.

While an adhesive material preapplied to the appropriate arm is preferred, obviously other types of adhesive bonding may be utilized without departing from the spirit and scope of this invention. For example, a heat sealing or the adhesive carried by selected areas 13 may also be utilized in conjunction with the tabs.

It should be clear that a butt joint is created with only very small lapped regions which is therefore easier to handle, reel and unreel in high speed applications.

Having described the invention it should also be understood that other changes can be made as described in the embodiment by one skilled in the art and still fall within the spirit and scope of the hereinafter following claims.

I claim:

1. A splice for joining successive series of flexible sheet-like multi-packaging devices arranged in separable, end-to-end manner, including a pair of tab members extending longitudinally from, and integrally attached to one longitudinal extremity of one of the devices in a first series, the tab members being laterally spaced from each other and situated on opposing sides of the longitudinal axis of the device, a surface area of each tab juxtaposed over predetermined surface areas of the free longitudinal extremity of a device in the second series and adhesively secured to the predetermined surface areas so that the free longitudinal extremities of the first and second series abut.

2. The splice of claim 1 wherein each tab member includes a base portion integral with the edge of the longitudinal extremity of the device and an arm region angularly disposed to the base.

3. The splice of claim 2 wherein the arm regions extend outwardly relative to the longitudinal axis of the device.

4. The splice of claim 2 wherein the base is partially slit at its laterally innermost edge.

5. The splice of claim 1 wherein the tab members carry the adhesive layer.

6. The splice of claim 1 wherein one tab member is juxtaposed over an upper surface area of the device in the second series while the other tab member is juxtaposed over a lower surface area of the device.

* * * * *